US006768463B2

(12) United States Patent
Chen et al.

(10) Patent No.: US 6,768,463 B2
(45) Date of Patent: Jul. 27, 2004

(54) MULTI-SURFACE PRINTED CONDUCTIVE TRACE ANTENNA AND METHOD OF RECEIVING SIGNALS USING A MULTI-SURFACE PRINTED CONDUCTIVE TRACE ANTENNA

(75) Inventors: Fu-Chiarng Chen, San Diego, CA (US); Allen M-T Tran, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 10/269,777

(22) Filed: Oct. 11, 2002

(65) Prior Publication Data

US 2003/0080920 A1 May 1, 2003

Related U.S. Application Data

(60) Provisional application No. 60/347,406, filed on Oct. 26, 2001.

(51) Int. Cl.[7] ..... H01Q 1/24

(52) U.S. Cl. ..... 343/700 MS; 343/702; 343/895

(58) Field of Search ..... 343/700 MS, 806, 343/846, 702, 895

(56) References Cited

U.S. PATENT DOCUMENTS 3,231,894 A 1/1966 Kiyoshi ..... 343/806
6,111,544 A * 8/2000 Dakeya et al. ..... 343/700 MS
6,476,766 B1 * 11/2002 Cohen ..... 343/700 MS

FOREIGN PATENT DOCUMENTS

| | | |
|---|---|---|
| DE | 19603803 | 8/1997 |
| JP | 5579503 | 6/1980 |
| WO | 0117061 | 3/2001 |

* cited by examiner

*Primary Examiner*—James Vannucci
(74) *Attorney, Agent, or Firm*—Philip Wadsworth; Charles D. Brown; Howard H. Seo

(57) ABSTRACT

A multiple-surface antenna, and a method of receiving signals using an antenna, are disclosed. The multi-surface antenna includes a multi-surface dielectric substrate and a conductive trace formed on at least two surfaces of the dielectric substrate. The conductive trace is formed in a predetermined pattern. The predetermined pattern may be a crossing pattern, or a series of symmetric shapes. The multi-surface dielectric substrate, having the trace formed thereon, may then be integrated entirely within a telephone handset. The method includes providing a multi-surface dielectric substrate, printing on at least two surfaces of the dielectric substrate a conductive trace formed into a periodic pattern, receiving at least one signal at the conductive trace, passing the received signal through at least a portion of the conductive trace, and feeding the received signal from the conductive trace to a coupled receiver. The coupled receiver may be a cellular or cordless telephone handset.

28 Claims, 5 Drawing Sheets

MULTI-SURFACE PRINTED CONDUCTIVE TRACE ANTENNA AND METHOD OF RECEIVING SIGNALS USING A MULTI-SURFACE PRINTED CONDUCTIVE TRACE ANTENNA

RELATED APPLICATIONS

This application claims priority to provisional application No. 60/347,406 filed Oct. 26, 2001, incorporated herein by reference.

BACKGROUND OF THE INVENTION

1. Field of the Invention

The present invention is directed generally to a method and apparatus for receiving electromagnetic signals and, more particularly, to a multi-surface printed conductive trace antenna and a method of receiving signals using a multi-surface printed conductive trace antenna.

2. Description of the Background

The use of cordless and cellular telephones is increasing exponentially in modern society. However, the antennae of early handsets for use in such telephone systems made portability of the handsets, over short or long distances, cumbersome. Additionally, storage of handsets having exterior antennae is difficult, as such handsets do not fit into pockets, purses, wallets, or similar spaces.

As the size of handset antennae has decreased, those handsets have become more portable and easier to store. However, the antennae still provide an impediment to portability and storability. Additionally, antennae could be easily broken if they extend too far to be easily stored or carried. Prior art attempts to decrease the size of the antenna used with handsets, or eliminate the exterior antenna completely, have typically led to a corresponding decrease in the performance of the antenna, and, thus, of the handset. Antennae printed on printed circuit boards have helped alleviate both problems, providing improved performance and smaller size, but such antennae still have a finite length to which they can be reduced while still retaining adequate performance characteristics.

Therefore, the need exists for an antenna for use with telephone handsets that provides an elimination of the need for the antenna to be mounted externally to the handset, and thus provides ease in portability and storability, without a sacrifice in antenna performance.

BRIEF SUMMARY OF THE INVENTION

The present invention is directed to a multiple-surface antenna. The multi-surface antenna includes a multi-surface dielectric substrate and a conductive trace formed on at least two surfaces of the dielectric substrate. The multi-surface dielectric substrate may include multiple layers. The conductive trace is positioned across at least two surfaces of the substrate, and is formed in a predetermined pattern. The predetermined pattern may be a crossing pattern, wherein the conductive trace overlaps itself at a plurality of orthogonal crossing points to form the crossing pattern, or a series of symmetric shapes. The multi-surface dielectric substrate, having the trace formed thereon, may then be integrated entirely within a telephone handset.

The present invention also includes a method of receiving signals using an antenna. The method includes providing a multi-surface dielectric substrate, printing on at least two surfaces of the dielectric substrate a conductive trace formed into a periodic pattern, receiving at least one signal at the conductive trace, passing the received signal through at least a portion of the conductive trace, and feeding the received signal from the conductive trace to a coupled receiver. The coupled receiver may be a cellular or cordless telephone handset.

The present invention solves problems experienced with the prior art because the present invention provides an antenna and a method for use with a telephone handset that provides an elimination of the need for an external antenna, and thus provides ease in portability and storability, without a sacrifice in antenna performance. The elimination of the need for an external antenna is provided through a decrease in physical length of the antenna, while maintaining the same physical area of the antenna, through the use of the conductive trace across multiple surfaces of a dielectric substrate. Those and other advantages and benefits of the present invention will become apparent from the detailed description of the invention hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical antenna and telephone system. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
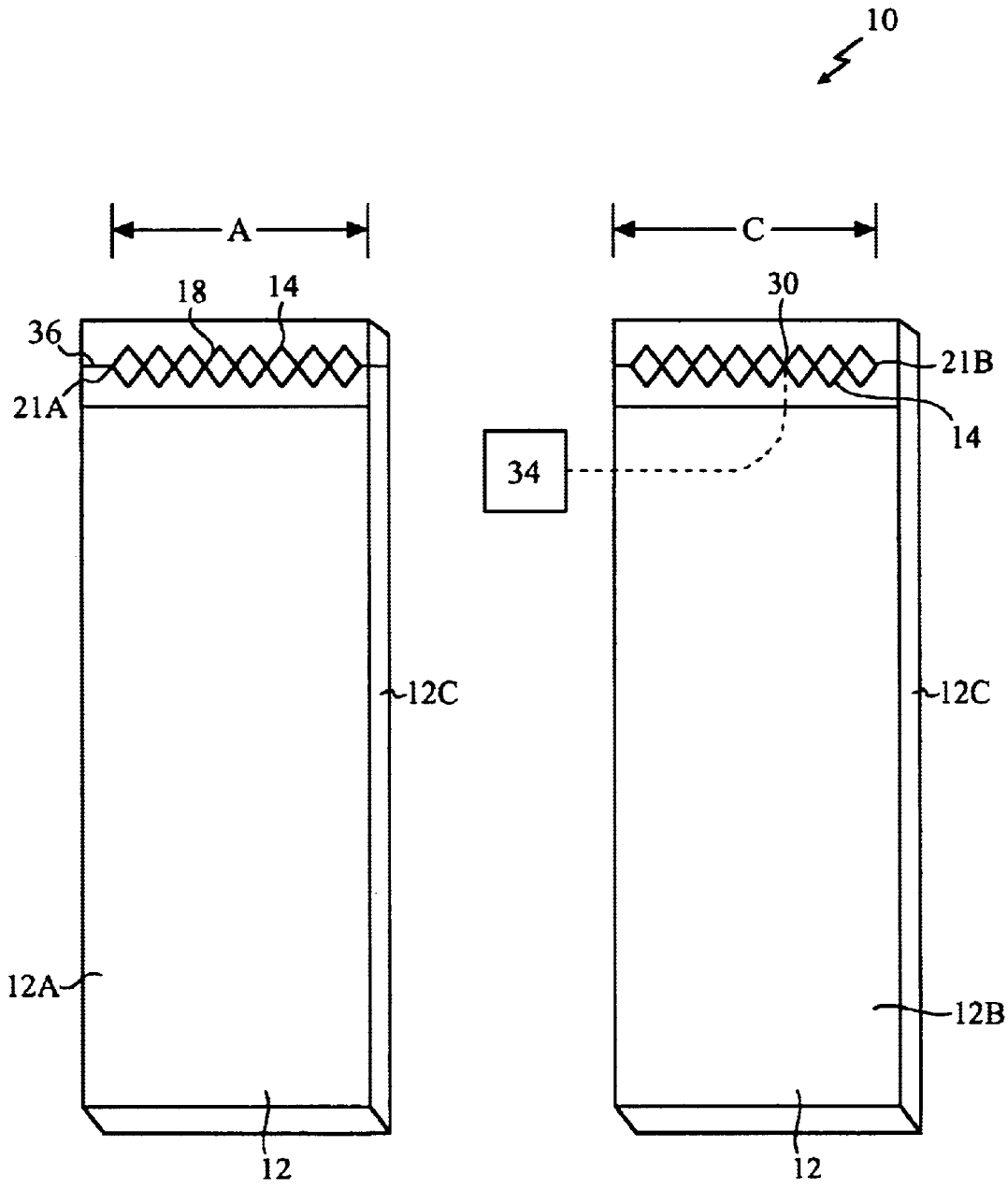
FIG. 1 is a split top view, side view, and bottom view of a multiple surface antenna.

FIG. 1 is a combined top view, side view, and bottom view of a multiple surface antenna 10. Antenna 10 includes a multi-surface dielectric substrate 12 and a conductive trace 14 positioned on at least two surfaces 12A, 12B of dielectric substrate 12, by printing for example.

Figure 1A:
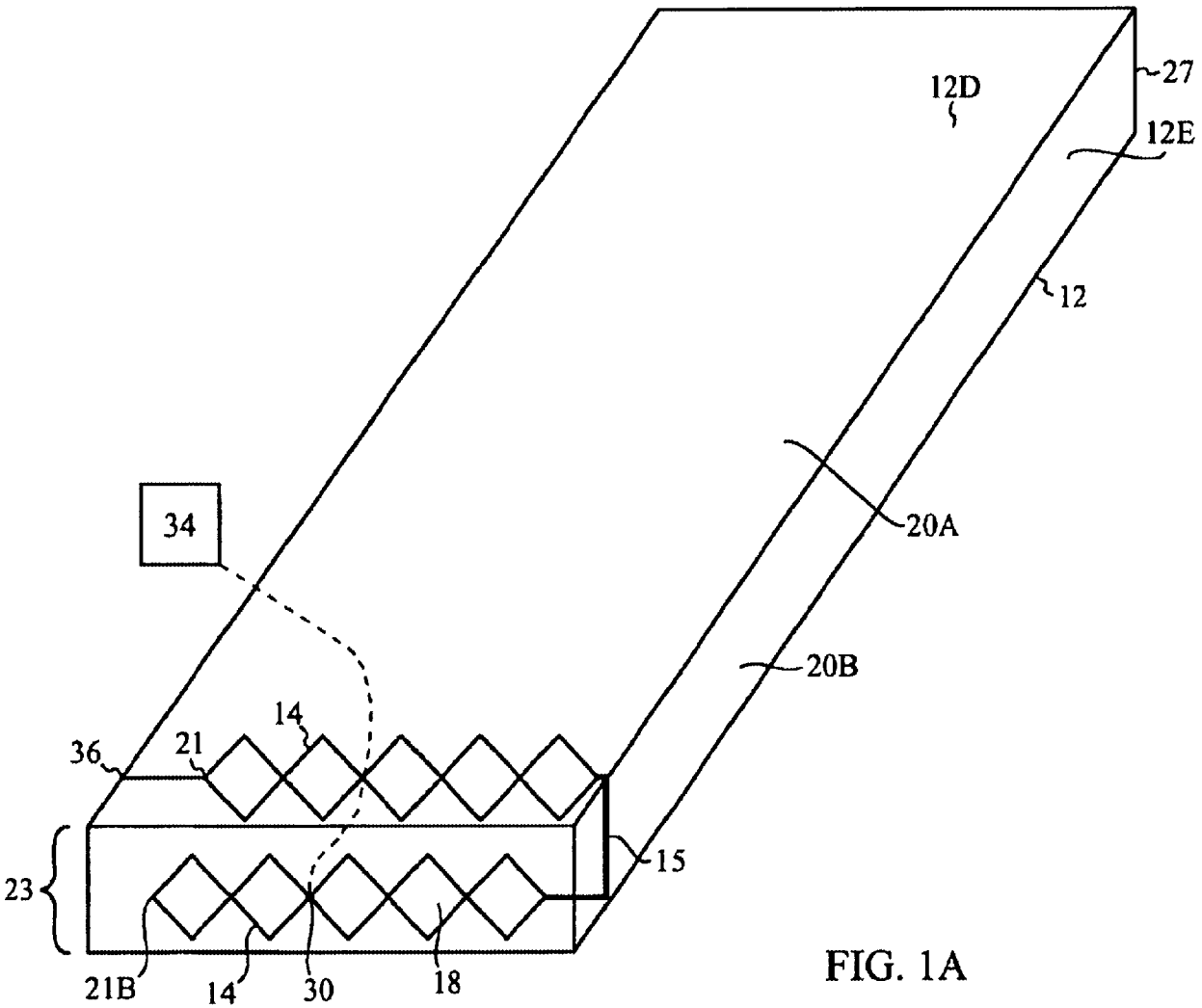
FIG. 1A is an isometric view of a multiple layer multi-surface antenna.

Dielectric substrate 12 can be of a type known in the art. Dielectric substrate 12 may be formed of, for example FR4, and may have a thickness in the range of 31 to 62 mils. In an embodiment of the present invention, dielectric substrate 12 may be a printed circuit board. The printed circuit board used as dielectric substrate 12 may be a RF board, for example, an FR4 printed circuit board. Dielectric substrate 12 of the present invention may have multiple surfaces. These multiple surfaces may include at least a top 12A and a bottom 12B surface, and may include surfaces along sides 12C of dielectric substrate 12. Further, dielectric substrate 12 of the present invention may have multiple layers 20A, 20B, with a gap 23, associated with substrate thickness, in between layers 20A, 20B, as shown in FIG. 1A. At least one surface 12D, 12E may be provided on each layer 20A, 20B, and each layer 20A, 20B may be a separate dielectric substrate, such as substrate 12 shown in FIG. 1, with spacers 27 between distinct substrates 12, or may be a single substrate bent upon itself. Thus, each layer of FIG. 1A may include a separate top, bottom, and sides as shown in FIG. 1, or may have a top, a bottom, and share a side with the opposing layer. Trace 14 may be positioned over multiple layers 20A, 20B, and trace 14 on multiple layers 20A, 20B may be directly electrically connected between layers by connection 15. This multiple layer embodiment is shown in FIG. 1A.

Conductive trace 14 may be formed of any conductor known in the art to provide adequate conductivity for use in a telephone antenna application, such as copper, for example. Conductive trace 14 may have a thickness in the range of 0.5 to 1 mil, and a width in the range of 25 mils. Conductor 14 may be printed onto at least two surfaces of dielectric substrate 12 to form conductive trace 14. For example, in an embodiment such as is shown in FIG. 1, the at least two surfaces are the top and bottom surface, and trace 14 on top and bottom surfaces 12A, 12B is also along side surface 12C, thereby connecting trace 14 on top and bottom surfaces 12A, 12B. Trace 14 may carry a signal along the at least two surfaces of dielectric substrate 12 from a first point 21A to a second point 21B, wherein the two points lie on different surfaces 12A, 12B. Trace 14 may be printed in a predetermined pattern. For example, conductive trace 14 may be meandered in a crossing fashion. In this embodiment, all meeting portions of trace 14 may be substantially orthogonal. The orthogonality is directly related to the cross coupling, wherein orthogonal traces may entirely prevent cross coupling. Trace 14 may form a plurality of symmetric shapes 18 as it is meandered. In one embodiment, symmetric shapes 18 may be closed shapes, such as a circle, a square, a rectangle 18, or any polygon. The entire trace 14 may be formed of one particular shape 18, such as rectangles 18 shown in FIG. 1 or may be a conglomeration of numerous different kinds of shapes 18 selected from a circle, square, rectangle 18, or polygon. Conductive trace 14 may also include a bias 36 coupled to one portion of trace 14.

Figure 1B:
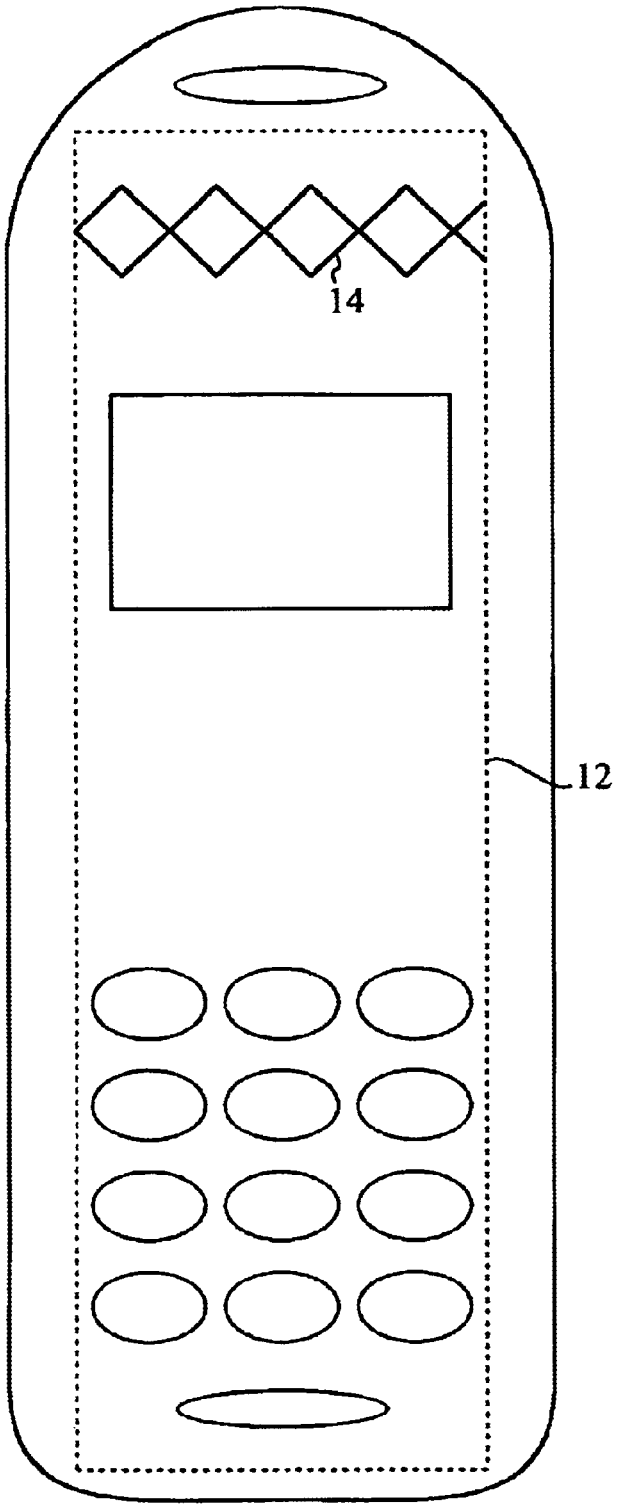
FIG. 1B is a diagram illustrating a telephone including a multi-surface antenna.
Figure 1C:
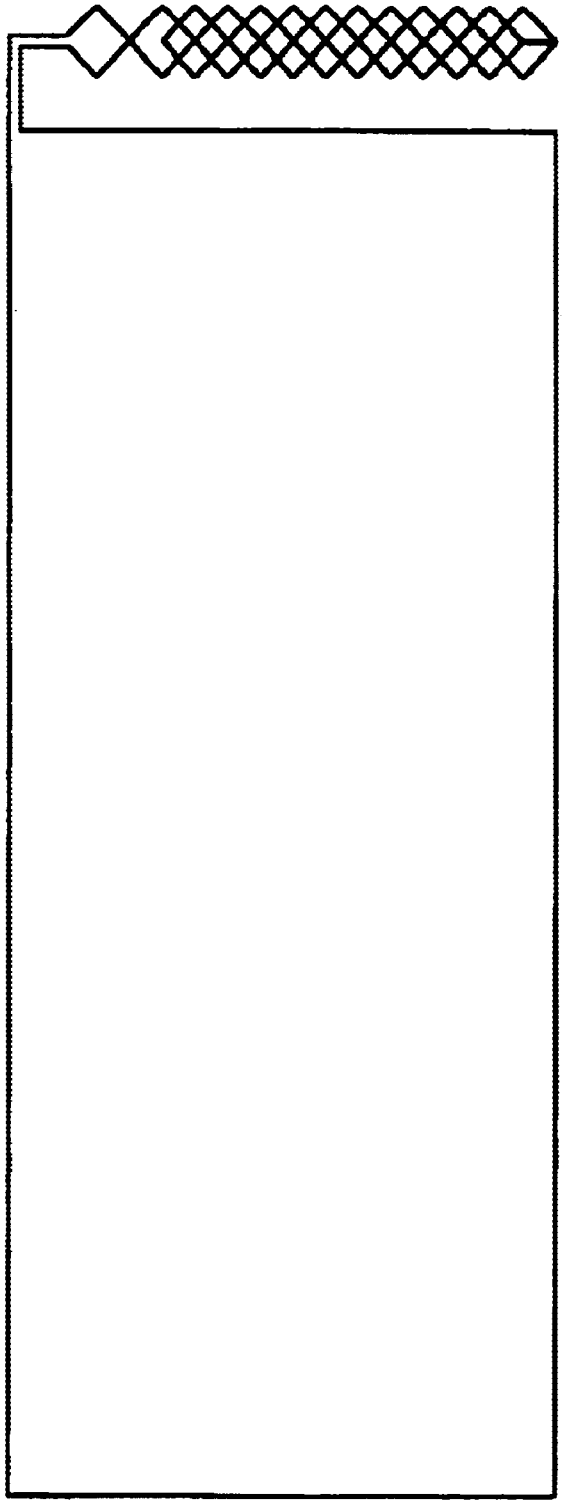
FIG. 1C is a illustration of a multiple layer antenna with the dielectric substrate removed for ease of viewing; and, FIG. 2 is a block diagram illustrating a method of receiving signals using an antenna.

In an embodiment of the present invention, trace 14 is located on surface 12A, and is positionally offset from trace 14 located on surface 12B. Removing dielectric substrate 12 to ease the viewing highlights this positional offset, as illustrated in FIG. 1C. The trace offset on opposing faces of the respective surfaces is evident in FIG. 1C. Without this offset, the trace on surface 12A and 12B would overlap. As a result of the offset of trace 14 on surface 12A and 12B, the pattern illustrated in FIG. 1C may be produced. This offset may reduce interlayer coupling. In FIG. 1C, trace 14 on surface 12A is offset from trace 14 on surface 12B by approximately one-half period of the pattern of trace 14. The amount of offset of trace 14 on opposite sides of dielectric substrate 12 is related to interlayer coupling, wherein the greater the offset is, the lower the coupling is. As is known to one of ordinary skill in the pertinent arts, the greatest offset that may be achieved is one-half of the period of trace 14.

Conductive trace 14 may be connected to a signal feed 30 located on the dielectric substrate 12. Signal feed 30 may be positioned at the corner of the dielectric substrate 12, and by so doing the antenna may be positioned substantially at the edge of dielectric substrate 12, thereby potentially maximizing the apparent length of the antenna. Signal feed 30 is adapted to pass the signal received at dielectric substrate 12 from trace 14 to a receiver 34. The signal, upon reaching receiver 34, has traversed a longer electrical space over a smaller physical length than a conventional antenna, because the physical area has been provided with a smaller length through the use of conductive trace 14 layered over multiple surfaces, thereby decreasing the necessary physical length of the antenna. In an illustrative embodiment, the electrical length of the antenna, which is the path traveled by a signal, may be in the range of 3.5 to 4.5 inches, while the actual length "L" of the antenna may be in the range of 3 inches. Length "L" is equivalent to the summation of lengths A, B, and C as labeled in FIG. 1.

In an embodiment of the present invention, receiver 34 is a telephone receiver, such as a receiver in cordless telephone handset or a cellular telephone handset. Also in an embodiment, substrate 12, having trace 14 thereon, is mounted completely within telephone handset 40, and no portion of the resulting antenna extends to the exterior of telephone handset 40, as is shown in FIG. 1B. The signal received at the telephone handset may be principally dependent on the signal received by antenna 10. Consequently, the bandwidth of antenna 10 of the present invention may be used to set the bandwidth for a telephone handset using the present invention.

Figure 2:
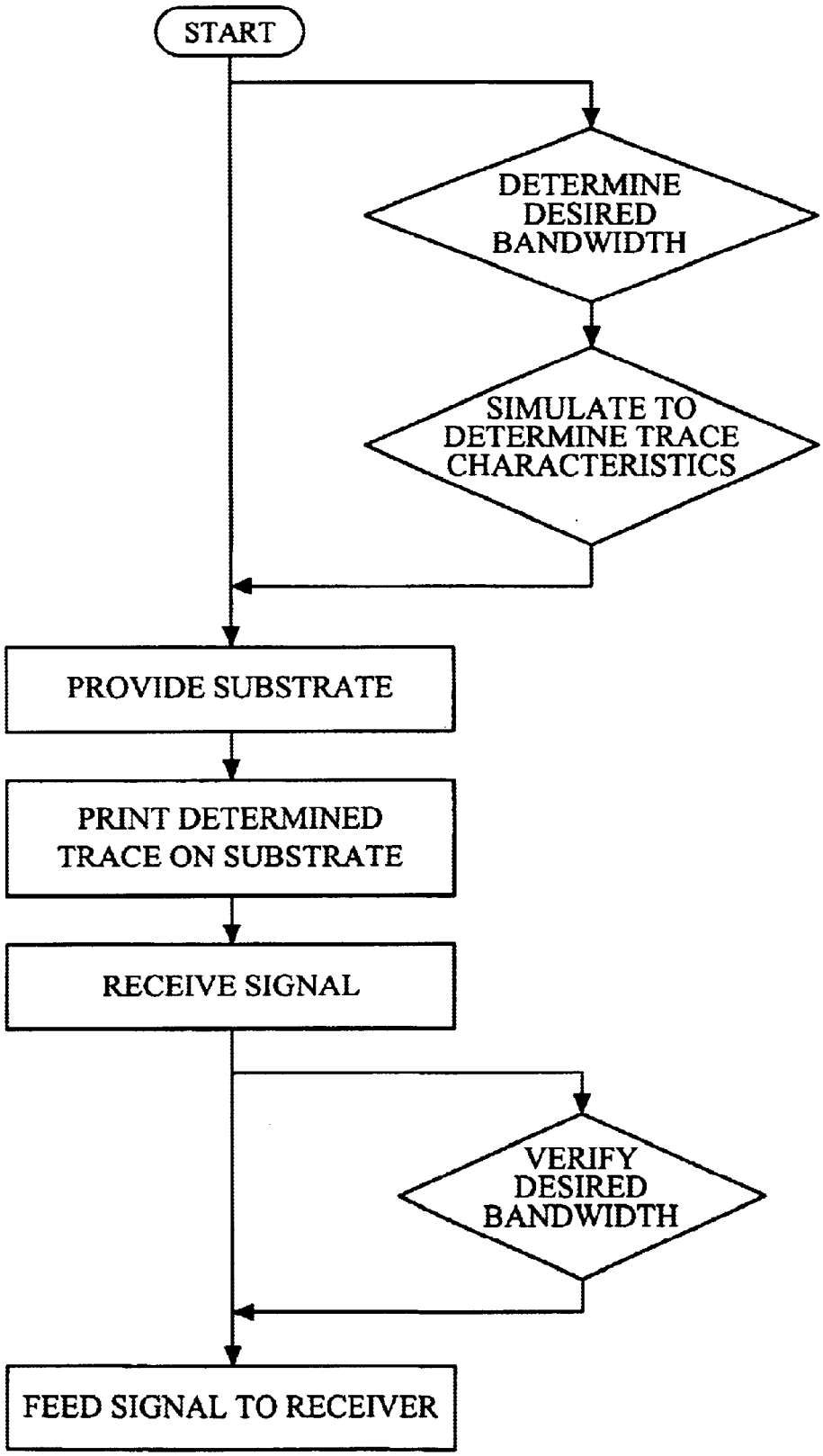

Referring now to FIG. 2, there is shown a block diagram of a method 100 for receiving signals using the printed antenna. Method 100 may include the steps of determining the desired bandwidth 110, simulating to determine trace characteristics producing the desired bandwidth 120, providing the substrate 130, printing the trace having the determined trace characteristics on substrate 140, receiving signal 150, verifying desired bandwidth 160, and feeding the signal to receiver 170.

In an embodiment of the present invention, method 100 may include the step of determining the desired bandwidth 110. Adjusting the bandwidth or the operation frequency of the mobile phone as required by different modes or different markets may be achieved using antenna 10. The signal received at the telephone handset is principally dependent on the signal received by antenna 10. Consequently, the bandwidth of antenna 10 of the present invention may be used to set the bandwidth for a telephone handset using the present invention. As such, the characteristics of the different modes or different markets for the mobile phone may be used to determine the desired bandwidth 110.

Once a desired bandwidth is determined, method 100 may include the step of simulating to determine trace characteristics to produce the desired bandwidth 120. Simulating the relationship between trace characteristics and desired bandwidth may be performed by representing the functioning of the antenna by assessing the functionality of a computer-simulated antenna. Those possessing an ordinary skill in the pertinent art are familiar with such simulations.

Method 100 may include the step of printing the determined trace on substrate 140. Printing step 140 may include printing the determined conductive trace crossing on dielectric substrate. Printing step 140 may also include printing the plurality of symmetric shapes as closed shapes. These closed shapes may include circles, squares, rectangles, or polygons, and the conductive trace may be entirely formed of one shape, or may be a combination of two or more shapes. Further, printing may be of any conductive material, such as, but not limited to, copper or solder plate copper. The thickness of the printing of the conductive material may be in the range of 0.5 to 1 mil. Printing of such materials on a dielectric substrate is well known in the art.

According to an aspect of the present invention, method 100 may include the step of verifying desired bandwidth 160. Monitoring the antenna 10 may provide verification 160, or the phone may be used in the designed for manner to verify usability. Other techniques for verifying the bandwidth of an antenna may be used, and are well-known to those possessing an ordinary skill in the pertinent arts.

Method 100 may include the step of feeding signal to receiver 170. Feeding step 170 may include feeding the signal between multiple layers of the conductive trace, in an embodiment wherein the dielectric substrate has multiple layers. In that case, the multiple layers are connected by a direct electrical connection.

Those of ordinary skill in the art will recognize that many modifications and variations of the present invention may be implemented. The foregoing description and the following claims are intended to cover all such modifications and variations.

What is claimed is:

1. An antenna system, comprising:

a multi-surface dielectric substrate; and a conductive trace positioned on at least two surfaces of said multi-surface dielectric substrate and having a predetermined pattern, wherein said conductive trace carries a signal from a first point on said multi-surface dielectric substrate to a second point on said multi-surface dielectric substrate, wherein said dielectric substrate has first and second opposing surfaces, and wherein the first point is on the first surface and the second point is on the second surface, and said conductive trace positioned on said first surface is offset by approximately one-half period of the pattern of said conductive trace with said conductive trace positioned on said second surface.

2. The antenna system of claim 1, wherein said conductive trace positioned on said first surface is offset with said conductive trace positioned on said second surface.

3. The antenna system of claim 1, wherein the first surface and the second surface are on opposing layers.

4. The antenna system of claim 1, wherein said conductive trace forms a plurality of symmetric shapes on said multi-surface dielectric substrate, and wherein each of said plurality of symmetric shapes is coupled to at least one other of said plurality of symmetric shapes.

5. The antenna system of claim 4, wherein the symmetric shapes are closed shapes.

6. The antenna system of claim 5, wherein the closed symmetric shapes are selected from the group consisting of a circle, a square and a rectangle.

7. The antenna system of claim 5, wherein the closed symmetric shapes are polygons.

8. The antenna system of claim 1, wherein the antenna system is communicatively connected to a telephone handset.

9. The antenna system of claim 1, wherein said conductive trace comprises a printed circuit.

10. The antenna system of claim 9, wherein said multi-surface dielectric substrate is an FR4 printed circuit board.

11. The antenna system of claim 1, wherein one of the first point and the second point is directly electrically connected to a signal feed.

12. The antenna system of claim 11, wherein one of the first point and the second point is directly electrically connected to a signal feed at a corner of said multi-surface dielectric substrate.

13. The antenna system of claim 1, wherein the predetermined pattern is a crossing pattern, and wherein said conductive trace overlaps itself at a plurality of crossing points to form the crossing pattern.

14. The antenna system of claim 13, wherein each crossing point comprises a meeting of at least two areas of said conductive trace, and wherein the at least two areas cross orthogonally.

15. The antenna system of claim 1, wherein said multi-surface dielectric substrate includes multiple layers.

16. The antenna system of claim 1, further comprising a telephone handset into which said multi-surface dielectric substrate, having said conductive trace thereon, is integrated.

17. The antenna system of claim 16, wherein said telephone handset comprises a cellular telephone handset.

18. The antenna system of claim 1, wherein said multi-surface dielectric substrate comprises an RF board.

19. An integrated telephone antenna, comprising:

a telephone handset;

a multi-surface dielectric substrate mounted entirely within said telephone handset; and a conductive trace positioned on at least two surfaces of said multi-surface dielectric substrate and having a predetermined pattern, wherein said conductive trace carries a signal from a first point on said multi-surface dielectric substrate to a second point on said multi-surface dielectric substrate, and wherein the conductive trace on opposing surfaces of the dielectric substrate is offset by approximately one-half period of the pattern of the conductive trace.

20. The antenna system of claim 19, wherein the predetermined pattern is a crossing pattern, and wherein said conductive trace overlaps itself at a plurality of crossing points to form the crossing pattern.

21. The antenna system of claim 20, wherein each crossing point comprises a meeting of at least two areas of said conductive trace, and wherein the at least two areas cross orthogonally.

22. The antenna system of claim 19, wherein said multi surface dielectric substrate includes multiple layers.

23. The antenna system of claim 19, wherein said telephone handset comprises a cellular telephone handset.

24. An integrated telephone antenna, comprising:

a telephone handset;

means for carrying a conductive trace mounted entirely within said telephone handset, wherein said means for carrying includes at least two surfaces; and a conductive trace positioned on at least two surfaces of said means for carrying, said conductive trace having a predetermined pattern, wherein said conductive trace carries a signal from a first point to a second point, and wherein the conductive trace on opposing surfaces of the dielectric substrate is offset by approximately one-half period of the pattern of the conductive trace.

25. A method of receiving signals using an antenna, comprising;

providing a multi-surface dielectric substrate;

printing on at least two surfaces of the multi-surface dielectric substrate a conductive trace in a predetermined pattern;

receiving at least one signal at the conductive trace;

passing the received signal through at least a portion of the conductive trace; and feeding the received signal from the conductive trace to a coupled receiver, and wherein the conductive trace on opposing surfaces of the dielectric substrate is offset by approximately one-half period of the pattern of the conductive trace.

26. The method of claim 25, wherein said printing comprises printing the conductive trace crossing on itself at a plurality of crossing points, and wherein the conductive trace meets upon itself orthogonally at each crossing point.

27. The method of claim 25, wherein said printing comprises copper printing.

28. The method of claim 25, further comprising controlling a bandwidth of the coupled receiver using a simulation to design said conductive trace prior to said printing.

* * * * *